US010590368B2

(12) United States Patent
Andersen

(10) Patent No.: US 10,590,368 B2
(45) Date of Patent: Mar. 17, 2020

(54) STABLE ENZYME SOLUTIONS AND METHOD OF MANUFACTURING

(75) Inventor: Kim Bruno Andersen, Vaerloese (DK)

(73) Assignee: NOVOZYMES A/S, Bagsvaerd (DK)

( * ) Notice: Subject to any disclaimer, the term of this patent is extended or adjusted under 35 U.S.C. 154(b) by 389 days.

(21) Appl. No.: 12/530,968

(22) PCT Filed: Mar. 27, 2008

(86) PCT No.: PCT/EP2008/053660

§ 371 (c)(1),
(2), (4) Date: Sep. 11, 2009

(87) PCT Pub. No.: WO2008/116915

PCT Pub. Date: Oct. 2, 2008

(65) Prior Publication Data

US 2010/0120649 A1 May 13, 2010

Related U.S. Application Data

(60) Provisional application No. 60/909,756, filed on Apr. 3, 2007.

(30) Foreign Application Priority Data

Mar. 27, 2007 (DK) ..... 2007 00472

(51) Int. Cl.

| | |
|---|---|
| ***C11D 3/386*** | (2006.01) |
| ***C11D 3/02*** | (2006.01) |
| ***C11D 3/20*** | (2006.01) |
| ***C11D 3/04*** | (2006.01) |
| ***C11D 3/16*** | (2006.01) |

(52) U.S. Cl.

CPC ..... *C11D 3/38663* (2013.01); *C11D 3/046* (2013.01); *C11D 3/048* (2013.01); *C11D 3/166* (2013.01); *C11D 3/2075* (2013.01)

(58) Field of Classification Search

CPC ..... C11D 3/386; C11D 3/3932; C11D 17/043; C11D 3/28618; C11D 3/38627; C11D 3/38618; C11D 3/3947; C11D 3/2082; A61K 45/06

USPC ..... 510/320–465; 435/188

See application file for complete search history.

(56) References Cited

U.S. PATENT DOCUMENTS

| | | | | | |
|---|---|---|---|---|---|
| 5,431,842 | A | | 7/1995 | Panandiker | |
| 5,510,052 | A | | 4/1996 | McCandlish | |
| 5,691,292 | A | * | 11/1997 | Marshall et al. | 510/221 |
| 5,840,677 | A | * | 11/1998 | Nielsen et al. | 424/94.2 |
| 5,972,873 | A | * | 10/1999 | Nielsen et al. | 510/392 |
| 5,998,350 | A | * | 12/1999 | Burns et al. | 510/320 |
| 6,093,856 | A | | 7/2000 | Cripe | |
| 6,172,021 | B1 | * | 1/2001 | Ofosu-Asante | C11D 1/90 510/237 |
| 6,673,763 | B1 | * | 1/2004 | Hansen | C11D 3/38672 435/188 |
| 2003/0109406 | A1 | | 6/2003 | Cooney | |
| 2003/0157088 | A1 | | 8/2003 | Elliot | |
| 2004/0033927 | A1 | * | 2/2004 | Simonsen | A21D 8/042 510/445 |
| 2006/0205628 | A1 | * | 9/2006 | Deinhammer et al. | 510/386 |
| 2007/0060493 | A1 | * | 3/2007 | Nielsen | 510/386 |
| 2007/0111914 | A1 | * | 5/2007 | Hsu | C11D 1/74 510/267 |
| 2007/0179074 | A1 | * | 8/2007 | Souter et al. | 510/320 |
| 2008/0004201 | A1 | * | 1/2008 | Boutique et al. | 510/393 |

FOREIGN PATENT DOCUMENTS

| | | | | | |
|---|---|---|---|---|---|
| EP | 0481542 | A2 | | 4/1992 | |
| EP | 0 832 174 | | | 5/2002 | |
| WO | WO 92/19707 | | | 11/1992 | |
| WO | WO9219708 | | * | 11/1992 | C11D 3/28 |
| WO | 1994029428 | A1 | | 12/1994 | |
| WO | WO 95/02046 | | | 1/1995 | |
| WO | 199512655 | A1 | | 5/1995 | |
| WO | WO 96/21716 | | | 7/1996 | |
| WO | WO 96/41859 | | | 12/1996 | |
| WO | 2001096518 | A1 | | 12/2001 | |
| WO | 2002008398 | A2 | | 1/2002 | |
| WO | 2002024851 | A1 | | 3/2002 | |
| WO | 2003041680 | A1 | | 5/2003 | |
| WO | 2003083030 | A1 | | 10/2003 | |
| WO | WO 2004/009752 | | | 1/2004 | |
| WO | WO2004074419 | A2 | * | 9/2004 | C11D 3/386 |
| WO | 2004/113484 | A1 | | 12/2004 | |
| WO | WO 2007/025549 | | | 3/2007 | |
| WO | 2008/021817 | A2 | | 2/2008 | |
| WO | 2008/116915 | A1 | | 10/2008 | |
| WO | 2008116915 | A1 | | 10/2008 | |

OTHER PUBLICATIONS

Philip et al., "Kinetics of Subtilisin and Thiolsubtilisin", Molecular & Cellular Biochemistry, vol. 51, pp. 5-32 (1983).

Keller et al., "Probing the Specificity of the $S_1$ Binding Site of Subtilisin Carlsberg with Boronic Acids", Biochemical and Biophysical Research Communications, vol. 176, No. 1, pp. 401-405 (1991).

International Search Report in corresponding international application No. PCT/EP2008/053660 dated Jun. 20, 2008.

Akparov et a1, 1978, J Chromatography, vol. 155, pp. 329-336.

Liu et al, 2005, HB Affinity Chromato, vol. 92, pp. 215-229.

Phillip et al, 1971, PNAS, vol. 68, pp. 478-480.

Zhang et al, 2006, Curr Opin Chem Biol, vol. 10, pp. 658-663.

Lyhne-Lversen et al, 2006, Acta Cryst, pp. 849-854.

* cited by examiner

*Primary Examiner* — Tri V Nguyen

(74) *Attorney, Agent, or Firm* — Eric Fechter

(57) ABSTRACT

The invention relates to the stabilization during storage of enzymes comprised in liquid detergent compositions.

14 Claims, No Drawings

STABLE ENZYME SOLUTIONS AND METHOD OF MANUFACTURING

CROSS-REFERENCE TO RELATED APPLICATIONS

This application is a 35 U.S.C. 371 national application of PCT/EP2008/053660 filed Mar. 27, 2008, which claims priority or the benefit under 35 U.S.C. 119 of Danish application no. PA 2007 00472 filed Mar. 27, 2007 and U.S. provisional application No. 60/909,756 filed Apr. 3, 2007, the contents of which are fully incorporated herein by reference.

FIELD OF INVENTION

The present disclosure relates to a liquid composition comprising or including an enzyme, an inhibitor and an inhibitor booster.

BACKGROUND

Storage stability problems are well known in enzyme containing liquids such as enzyme containing liquid detergents. This is especially true in protease containing liquid detergents.

The prior art has dealt extensively with improving the storage stability, for example by adding a protease inhibitor.

Boric acid and boronic acids are known to reversibly inhibit proteolytic enzymes. A discussion of the inhibition of one serine protease, subtilisin, by boronic acid is provided in Molecular & Cellular Biochemistry 51, 1983, pp. 5-32.

Boronic acids have very different capacities as subtilisin inhibitors. Boronic acids containing only alkyl groups such as methyl, butyl or 2-cyclohexylethyl are poor inhibitors with methylboronic acid as the poorest inhibitor, whereas boronic acids bearing aromatic groups such as phenyl, 4-methoxyphenyl or 3,5-dichlorophenyl are good inhibitors with 3,5-dichlorophenylboronic acid as a particularly effective one (see Keller et al, Biochem. Biophys. Res. Com. 176, 1991, pp. 401-405).

It is also known that aryl boronic acids which have a substitution at the 3-position relative to boron are reversible protease inhibitors. In WO 92/19707, acetamidophenyl boronic acid is described as an inhibitor of proteolytic enzymes.

Moreover EP 0 832 174 describes phenyl boronic acid derivatives substituted in the para-position with a >C=O adjacent to the phenyl boronic acid have good capacities as enzyme stabilizers in liquids.

There remains room for improvement in formulating, manufacturing and packaging liquid enzyme compositions that include sensitive enzymes to provide detergent compositions that do not loose enzyme activity during shipment and storage.

SUMMARY OF THE INVENTION

An object of the present invention is to provide a liquid enzyme composition with improved enzyme stability. A further object of the present invention is to provide a method for manufacturing the liquid enzyme composition.

It has been found that adding an inhibitor booster such as soluble salt to a liquid enzyme composition including an enzyme and an inhibitor such as a phenyl boronic acid or a phenyl boronic acid derivative improves the inhibitors effect significantly and thereby improves the storage stability of the enzyme with regard to enzyme activity.

The present invention provides a liquid enzyme composition including an enzyme constituent, a phenyl boronic acid constituent or a derivative thereof and a water soluble salt constituent.

The present invention further relates to the manufacture of the liquid enzyme composition and its use.

The objects of the present invention have been obtained by providing a liquid composition including an enzyme constituent, a phenyl boronic acid constituent or a derivative thereof, and a dissolved salt constituent. In embodiments, the enzyme constituent is a protease such as a serine protease. The salt constituent may include cations such as Cu, Ca, Mg, Zn, Na, K, $NH_4$ and combinations thereof. In embodiments, the salt constituent may include cations selected from the group consisting of Mg, Zn, $NH_4$, and combinations thereof. In some embodiments, the salt constituent includes anions comprising chloride, sulphate, nitrate, phosphate, carbonate, formiate, and combinations thereof. Still yet, the salt constituent may include anions such as chloride, sulphate, nitrate, and combinations thereof.

In a particular embodiment the cations are selected from the group consisting of Cu, Ca, Mg, Zn, Na, K, $NH_4$ and the anions are selected from the group consisting of chloride, sulphate, nitrate, phosphate, carbonate and formiate.

In some embodiments, the pH of the liquid composition is 7 to 10.5, and in some embodiments, the pH of the liquid composition is 8 to 9.5.

In some embodiments, the salt constituent is present in an amount of 0.1-20% by weight of the total composition.

The objects of the present disclosure are also met by providing a detergent composition, such as a laundry detergent composition or a dishwashing composition.

The objects of the present invention are also achievable by providing a process for manufacturing of a liquid composition including the steps of: providing a liquid; adding a water soluble salt to the liquid of a); adding an enzyme and a phenyl boronic acid or a derivative thereof in a), simultaneously with b) or after b); and mixing the liquid composition. In embodiments, the process may also include the step of adjusting the pH to 7 to 9.5, or to 8 to 9.

The objects of the present invention are also met by cleaning an object with compositions in accordance with the present disclosure.

The objects of the present invention are also met using a salt constituent to boost or enhance the inhibitor effect of a phenyl boronic acid or a derivative thereof in a liquid enzyme composition.

DEFINITIONS

As used herein the term "% RH" refers to the relative humidity of air. 100% RH is air saturated with water moisture at a fixed temperature and % RH thus reflects the percent moisture saturation of the air.

The term "constant humidity" (in the context of the invention sometimes abbreviated as CH) of a compound or substance refers to the % RH of atmospheric air in equilibrium with a saturated aqueous solution of the compound in contact with the solid phase of the compound, all confined within a closed space at a given temperature. This definition is in accordance with "*Handbook of chemistry and physics*" CRC Press, Inc., Cleveland, USA, 58th edition, p E46, 1977-1978. Accordingly $CH_{20°\ C.}$=50% for a compound means that air with a 50% humidity will be in equilibrium with a saturated aqueous solution of the compound at 20° C.

Accordingly the term constant humidity is a measure of the hygroscopic properties of a compound.

The term "pH" of a compound in the context of the invention is to be understood as the pH of a 10% w/w aqueous solution of the compound.

DETAILED DESCRIPTION OF THE PREFERRED EMBODIMENTS

The present disclosure relates to liquid enzyme compositions including one or more enzyme constituents, one or more inhibitors and one or more inhibitor boosters. It has been found that salt works as an inhibitor booster in liquid enzyme compositions if the inhibitor is boronic acid or a derivative thereof.

Not wishing to be bound by any theory of the present disclosure it is believed that the inhibitor effect of phenyl boronic acid derivatives is negatively affected by a combination of alkaline pH and high water content (water activity) in detergent compositions. At alkaline pH the boronic acid becomes charged via its antibase-reaction increasing the water solubility. Further, this lowers the molecule's affinity towards the photolytic site it has a propensity to inhibit. The equilibrium (1) is shifted towards the non inhibited protease (right):

$$EZ[I] \leftrightarrow EZ+I \quad (1)$$

EZ is a protease, I is the inhibitor and EZ[I] is the inactivated complex.

By lowering the inhibitor's solubility in the detergent matrix the equilibrium (1) will shift towards the inhibited protease complex (left)—reducing the likelihood that the inhibitor will precipitate out of solution.

The benzene ring is highly hydrophobic—thus it is believed that adding one or more salt constituents to a detergent composition will make it unfavourable for the benzene ring to stay in solution, and more likely to interact with the active site of a protease.

It is further believed that the boost effect may enclose some minor structural changes in the protease, facilitating a better match of the inhibitor into the active site.

The Inhibitor Constituent

One or more inhibitors are present in compositions in accordance with the present disclosure. In embodiments, the enzyme inhibitor of the present invention is either boronic acid and/or a derivative thereof.

In a particular embodiment of the present invention the inhibitor is a phenyl boronic acid and/or a derivative thereof.

The present invention covers liquid enzyme compositions including boronic acid or derivatives thereof. In a particular embodiment the invention covers liquid enzyme compositions comprising phenyl boronic acid or derivatives thereof.

In a particular embodiment of the present invention the inhibitor is a naphthalene boronic acid derivative.

The inhibitor constituent is present in an amount sufficient to provide a beneficial effect. In embodiments the inhibitor constituent is added in an amount of 0.1 to 20% (w/w) of the total liquid composition, in some embodiments in an amount of 0.5 to 8% (w/w) of the total composition, and in some embodiments in an amount of 1 to 5% (w/w) of the total composition.

In a particular embodiment of the present invention the amount of inhibitor is above 1% (w/w) of the total liquid composition. In a more particular embodiment of the present invention the amount of inhibitor constituent is above 1.5% (w/w) of the total liquid composition. In a most particular embodiment of the present invention the amount of inhibitor is above 2% (w/w) of the total liquid composition.

In a particular embodiment of the present invention the amount of inhibitor added to the enzyme liquid composition in an amount of at least 0.1% (w/w) of the total composition. In a more particular embodiment of the present invention the inhibitor is added to the liquid enzyme composition in an amount of at least 0.5% (w/w) or the total composition. In an even more particular embodiment the inhibitor is added to the liquid enzyme composition in an amount of at least 1% (w/w) of the total composition. In a most particular embodiment of the present invention the inhibitor constituent is added to the liquid enzyme composition in an amount of at least 1.5% (w/w) of the total composition.

In a particular embodiment of the present invention the amount of inhibitor added to the enzyme liquid composition is an amount less than 20% (w/w) of the total composition. In a more particular embodiment of the present invention the amount of inhibitor added to the enzyme liquid composition is an amount of less than 15% (w/w) of the total composition. In an even more particular embodiment of the present invention the amount of inhibitor added to the enzyme liquid composition is less than 10% (w/w) of the total composition. In a most particular embodiment of the present invention the amount of inhibitor added to the enzyme liquid additive is less than 5% (w/w) of the total composition.

Suitable non-limiting examples of phenyl boronic acid derivatives for use in accordance with the present disclosure have the following formula:

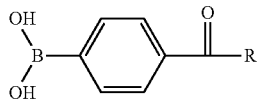

wherein R is selected from the group consisting of hydrogen, hydroxy, $C_1$-$C_6$ alkyl, substituted $C_1$-$C_6$ alkyl, $C_1$-$C_6$ alkenyl and substituted $C_1$-$C_6$ alkenyl.

In one embodiment of the present disclosure a liquid composition includes an enzyme constituent and a phenyl boronic acid derivative enzyme inhibitor of the formula disclosed above, wherein R is a $C_1$-$C_6$ alkyl, in particular wherein R is $CH_3$, $CH_3CH_2$ or $CH_3CH_2CH_2$, or wherein R is hydrogen. In one embodiment of the present disclosure the inhibitor of the enzyme is 4-formyl-phenyl-boronic acid (4-FPBA).

In embodiments, suitable non-limiting examples of inhibitors include compounds selected from the group consisting of:

thiophene-2 boronic acid, thiophene-3 boronic acid, acetamidophenyl boronic acid, benzofuran-2 boronic acid, naphtalene-1 boronic acid, naphtalene-2 boronic acid, 2-FPBA, 3-FBPA, 4-FPBA, 1-thianthrene boronic acid, 4-dibenzofuran boronic acid, 5-methylthiophene-2 boronic, acid, thionaphtrene boronic acid, furan-2 boronic acid, furan-3 boronic acid, 4,4 biphenyl-diborinic acid, 6-hydroxy-2-naphtalene, 4-(methylthio) phenyl boronic acid, 4 (trimethyl-silyl)phenyl boronic acid, 3-bromothiophene boronic acid, 4-methylthiophene boronic acid, 2-naphtyl boronic acid, 5-bromothiphene boronic acid, 5-chlorothiophene boronic acid, dimethylthiophene boronic acid, 2-bromophenyl boronic acid, 3-chlorophenyl boronic acid, 3-methoxy-2-thiophene, p-methyl-phenylethyl boronic acid, 2-thianthrene boronic acid, di-benzothiophene boronic acid, 4-carboxyphenyl boronic acid, 9-anthryl boronic acid, 3,5 dichlorophenyl boronic, acid, diphenyl boronic acidanhydride, o-chlorophenyl boronic acid, p-chlorophenyl boronic acid m-bromophenyl boronic acid, p-bromophenyl boronic acid, p-flourophenyl boronic acid, p-tolyl boronic acid, o-tolyl boronic acid, octyl boronic acid, 1,3,5 trimethylphenyl boronic acid, 3-chloro-4-flourophenyl boronic acid, 3-aminophenyl boronic acid, 3,5-bis-(triflouromethyl)phenyl boronic acid, 2,4 dichlorophenyl boronic acid, 4-methoxyphenyl boronic acid, and combinations thereof Further non-limiting examples of suitable boronic acid derivatives suitable as inhibitors are described in U.S. Pat. Nos. 4,963,655, 5,159,060, WO 95/12655, WO 95/29223, WO 92/19707, WO 94/04653, WO 94/04654, U.S. Pat. Nos. 5,442,100, 5,488,157 and 5,472,628 (herein incorporated by reference in their entirety).

In one embodiment the composition comprises an enzyme, an inhibitor constituent, where the constituent is either boronic acid or a derivative thereof and an inhibitor booster constituent.

Inhibitor Booster Constituent

One or more inhibitor boosters are present in compositions in accordance with the present disclosure. The inhibitor booster constituent may be present in amounts sufficient to provide a beneficial effect, for example, the inhibitor booster may be present in an effective amount. In one embodiment the inhibitor booster is water soluble. In the context of the present disclosure the inhibitor booster may have a solubility of at least 1 gram in 100 grams of water at 20° C., such as a solubility of at least 2 grams in 100 grams of water at 20° C. In some embodiments of the present disclosure the inhibitor booster is on dissolved form. In one embodiment where the inhibitor booster is a salt, the salt is dissolved and is therefore on ionic form. In some embodiments only part of the salt is dissolved and the rest is on solid form.

The inhibitor booster is capable of increasing or enhancing the effect of the inhibitor constituent on the enzyme constituent. In embodiments, the inhibitor booster may be one or more soluble salts.

Non-limiting examples of suitable soluble salts may be inorganic salt or organic salts, and combinations thereof. Non-limiting examples of suitable cations are ammonium or metal ions and alkali or earth alkali metal ions, such as sodium, potassium, magnesium, calcium, zinc or aluminium, and combinations thereof. Non-limiting examples of anions include chloride, iodide, sulfate, sulfite, bisulfite, thiosulfate, phosphonate, phosphate, monobasic phosphate, dibasic phosphate, hypophosphite, dihydrogen pyrophosphate, nitrate, chloride, carbonate, bicarbonate, metasilicate, simple organic acids (less than 10 carbon atoms e.g. 6 or less carbon atoms) such as citrate, malate, maleate, malonate, succinate, lactate, formate, acetate, butyrate, propionate, benzoate, tartrate, ascorbate or gluconate, and combinations thereof. In particular alkali- or earth alkali metal salts of sulfate, sulfite, phosphate, phosphonate, nitrate, chloride or carbonate or salts of simple organic acids such as citrate, malonate or acetate, and combinations thereof may be used. Specific non-limiting examples include $NaH_2PO_4$, $Na_2HPO_4$, $Na_3PO_4$, $(NH_4)H_2PO_4$, $K_2HPO_4$, $KH_2PO_4$, $Na_2SO_4$, $K_2SO_4$, $KHSO_4$, $ZnSO_4$, $MgSO_4$, $CuSO_4$, $Mg(NO_3)_2$, $(NH_4)_2SO_4$, sodium borate, magnesium acetate, sodium citrate, and combinations thereof.

The salt may also be a hydrated salt, i.e. a crystalline salt hydrate with bound water(s) of crystallization, such as described in WO 99/32595. Examples of hydrated salts include magnesium sulfate heptahydrate ($MgSO_4(7H_2O)$), zinc sulfate heptahydrate ($ZnSO_4(7H_2O)$), sodium phosphate dibasic heptahydrate ($Na_2HPO_4(7H_2O)$), magnesium nitrate hexahydrate ($Mg(NO_3)_2(6H_2O)$), sodium borate decahydrate, sodium citrate dihydrate and magnesium acetate tetrahydrate.

In a particular embodiment of the present invention the salt is selected from the group consisting of $MgCl_2$, $MgSO_4$, $Mg(NO_3)_2$, $ZnCl_2$, $ZnSO_4$, $ZN(NO_3)_2$, $NH_4Cl$, $NH_4NO_3$, $(NH_4)_2SO_4$, $CaCl_2$, NaCl, KCl, $Na_2SO_4$, $NaNO_3$, $NaH_2PO_4$, $C_2H_3NaO_2$, $NaHCO_3$ and sodium formiate. In another particular embodiment of the present invention the salt is selected from the group consisting of MgCl, $MgSO_4$, $Mg(NO_3))_2$, $ZnCl_2$, $ZnSO_4$, $ZN(NO_3)_2$, $NH_4Cl$, $NH_4NO_3$, $(NH_4)_2SO_4$, $CaCl_2$, KCl, $Na_2SO_4$, $NaNO_3$, $NaH_2PO_4$, $C_2H_3NaO_2$, $NaHCO_3$ and sodium formiate.

In a particular embodiment of the present invention the salt is selected from the group consisting of MgCl, $MgSO_4$, $Mg(NO_3))_2$, $ZnCl_2$, $ZnSO_4$, $ZN(NO_3)_2$, $NH_4Cl$, $NH_4NO_3$, $(NH_4)_2SO_4$, KCl, $Na_2SO_4$, $NaNO_3$, $NaH_2PO_4$, $C_2H_3NaO_2$, and sodium formiate.

In yet another particular embodiment of the present invention the salt is selected from the group consisting of $MgCl_2$, $MgSO_4$, $Mg(NO_3))_2$, $ZnCl_2$, $ZnSO_4$, $ZN(NO_3)_2$, $NH_4Cl$, $NH_4NO_3$, $(NH_4)_2SO_4$, $NaNO_3$ and $NaH_2PO_4$.

In yet another particular embodiment of the present invention the salt is selected from the group consisting of $MgCl_2$, $MgSO_4$, $Mg(NO_3))_2$, $NH_4Cl$, $NH_4NO_3$, $(NH_4)_2SO_4$, $NaNO_3$ and $NaH_2PO_4$.

In yet another particular embodiment of the present invention the salt is selected from the group consisting of $MgCl_2$, $MgSO_4$, $Mg(NO_3))_2$, $NH_4Cl$, $NH_4NO_3$ and $(NH_4)_2SO_4$.

In a particular embodiment of the present invention the cation is selected from Mg, Zn, Na, K or $NH_4$. In a more particular embodiment of the present invention the cation is selected from Mg or $NH_4$.

In a particular embodiment of the present invention the anion is selected from chloride, sulphate and nitrate.

The inhibitor booster may be added to the liquid detergent in liquid or solid form. If the inhibitor booster is added in liquid form it is in particularly as an aqueous liquid.

In one embodiment the composition does not comprise sodium dihydrogen phosphate or sodium acetate trihydrate.

In embodiments, compositions for use in accordance with the present disclosure contain one or more inhibitor boosters in an effective amount to improve stability and/or extend shelf life. As used herein "effective amount" refers to an amount of a inhibitor booster constituent in accordance with the present disclosure sufficient to induce a particular positive benefit to stability or shelf life of liquid enzyme composition in accordance with the present disclosure. The positive benefit can be cosmetic in nature, or activity-related, or a combination of the two. For example, in some embodiments, the residual activity of enzyme under stressed conditions may be 2 times, 3 times, 4 times, 5 times, 6 times, 7 times, 8 times, 9, times, 10 times longer than when compared to similar compositions devoid of the inhibitor booster. As used herein stressed conditions include, inter alia, storage at an elevated temperature of 40° C. for four weeks. In embodiments, the positive benefit is achieved by contacting a liquid enzyme compositions with a combination of inhibitor constituents and inhibitor booster constituents, to improve the stability and/or shelf life of the liquid enzyme composition.

For example, in some embodiments the residual activity of enzyme under stressed conditions may be more than 10%, 20%, 30%, 40%, 50%, 60%, 70%, where the stressed conditions include storage at an elevated temperature of 40° C. for four weeks.

The particular inhibitor booster constituent concentration applied generally depends on the purpose for which the composition is to be applied. For example, the concentration can vary depending upon the type of enzyme used and severity the stability and/or storage problems in solution. In embodiments, one or more inhibitor boosters are applied to a liquid enzyme composition such that the inhibitor booster concentration is in an amount of 0.1%-20% by weight of the total composition. In embodiments, one or more inhibitor boosters are present in an amount of about 0.5 to 10% by weight of the total composition.

In embodiments where the inhibitor booster is one or more salts, the amount of salt added to the detergent is in a particular embodiment 0.1%-20% by weight of the total detergent composition. The amount of salt added to the detergent is in a further particular embodiment 0.5-10% by weight. The amount of salt added to the detergent is in another particular embodiment 0.8-5% by weight. The amount of salt added to the detergent is in an even further particular embodiment 1-3% by weight.

The amount of cations ions present in the detergent is in a particular embodiment 0.005-10% by weight. The amount of cations ions present in the detergent is in another particular embodiment 0.05-4% by weight. The amount of cations ions present in the detergent is in a further particular embodiment 0.1-2% by weight.

In one embodiment the composition comprises an enzyme, an inhibitor constituent and an inhibitor booster constituent, where the inhibitor booster is one or more salts Enzymes The enzymes that can be stabilized according to the invention are in the context of the present invention referred to as "detersive enzymes", which as used herein means any enzyme which exerts their effects during the wash cycle, e.g. having a cleaning, fabric care, anti-redeposition and stain removing effect in a wash application and which enzymes are added for such a purpose.

According to the invention the liquid composition contains at least one enzyme. The enzyme may be any commercially available enzyme, in particular an enzyme selected from the group consisting of proteases, amylases, lipases, cellulases, lyases, oxidoreductases and any mixture thereof. Mixtures of enzymes from the same class (e.g. proteases) are also included.

According to the invention a liquid composition comprising a protease is preferred. In a particular embodiment a liquid composition comprising two or more enzymes in which the first enzyme is a protease and the second enzyme is selected from the group consisting of amylases, lipases, cellulases, lyases and oxidoreductases is preferred. In a more particular embodiment the second enzyme is a lipase.

It is to be understood that enzyme variants (produced, for example, by recombinant techniques) are included within the meaning of the term "enzyme". Examples of such enzyme variants are disclosed, e.g. in EP 251,446 (Genencor), WO 91/00345 (Novo Nordisk), EP 525,610 (Solvay) and WO 94/02618 (Gist-Brocades NV).

Enzymes can be classified on the basis of the handbook Enzyme Nomenclature from NC-IUBMB, 1992), see also the ENZYME site at the internet: http://www.expasy.ch/enzyme/. ENZYME is a repository of information relative to the nomenclature of enzymes. It is primarily based on the recommendations of the Nomenclature Committee of the International Union of Biochemistry and Molecular Biology (IUB-MB), Academic Press, Inc., 1992, and it describes each type of characterized enzyme for which an EC (Enzyme Commission) number has been provided (Bairoch A. The ENZYME database, 2000, Nucleic Acids Res 28:304-305). This IUB-MB Enzyme nomenclature is based on their substrate specificity and occasionally on their molecular mechanism; such a classification does not reflect the structural features of these enzymes.

Another classification of certain glycoside hydrolase enzymes, such as endoglucanase, xylanase, galactanase, mannanase, dextranase and alpha-galactosidase, in families based on amino acid sequence similarities has been proposed a few years ago. They currently fall into 90 different families: See the CAZy(ModO) internet site (Coutinho, P. M. & Henrissat, B. (1999) Carbohydrate-Active Enzymes server at URL: http://afmb.cnrs-mrs.fr/~cazy/CAZY/index.html (corresponding papers: Coutinho, P. M. & Henrissat, B. (1999) Carbohydrate-active enzymes: an integrated database approach. In "Recent Advances in Carbohydrate Bioengineering", H. J. Gilbert, G. Davies, B. Henrissat and B. Svensson eds., The Royal Society of Chemistry, Cambridge, pp. 3-12; Coutinho, P. M. & Henrissat, B. (1999) The modular structure of cellulases and other carbohydrate-active enzymes: an integrated database approach. In "Genetics, Biochemistry and Ecology of Cellulose Degradation", K. Ohmiya, K. Hayashi, K. Sakka, Y. Kobayashi, S. Karita and T. Kimura eds., Uni Publishers Co., Tokyo, pp. 15-23).

The liquid enzyme additive preferably comprise a protease, such as a serine protease. Proteases: Suitable proteases include those of animal, vegetable or microbial origin. Microbial origin is preferred. Chemically or genetically modified mutants are included. The protease may be a serine protease, preferably an alkaline microbial protease or a trypsin-like protease. Examples of al-kaline proteases are subtilisins, especially those derived from *Bacillus,* e.g., subtilisin Novo, subtilisin Carlsberg, subtilisin 309, subtilisin 147 and subtilisin 168 (described in WO 89/06279). Examples of trypsin-like proteases are tryp-sin (e.g. of porcine or bovine origin) and the Fusarium pro-tease described in WO 89/06270. In a particular embodiment of the present invention the protease is a serine protease. Serine proteases or serine endopeptidases (newer name) are a class of peptidases which are characterised by the presence of a serine residue in the active center of the enzyme.

Serine proteases: A serine protease is an enzyme which catalyzes the hydrolysis of peptide bonds, and in which there is an essential serine residue at the active site (White, Handler and Smith, 1973 "Principles of Biochemistry," Fifth Edition, McGraw-Hill Book Company, NY, pp. 271-272).

The bacterial serine proteases have molecular weights in the 20,000 to 45,000 Daltons range. They are inhibited by diisopropylfluorophosphate. They hydrolyze simple terminal esters and are similar in activity to eukaryotic chymotrypsin, also a serine protease. A more narrow term, alkaline protease, covering a sub group, reflects the high pH optimum of some of the serine proteases, from pH 9.0 to 11.0 (for review, see Priest (1977) Bacteriological Rev. 41 711-753).

Subtilases: A sub-group of the serine proteases tentatively designated subtilases has been proposed by Siezen et al. (1991), Protein Eng., 4 719-737. They are defined by homology analysis of more than 40 amino acid sequences of serine proteases previously referred to as subtilisin-like proteases. A subtilisin was previously defined as a serine protease produced by Gram-positive bacteria or fungi, and according to Siezen et al. now is a subgroup of the subtilases. A wide variety of subtilisins have been identified, and the amino acid sequence of a number of subtilisins have been determined. These include more than six subtilisins from *Bacillus* strains, namely, subtilisin 168, subtilisin BPN', subtilisin Carlsberg, subtilisin Y, subtilisin amylosacchariticus, and mesentericopeptidase (Kurihara et al. (1972) J. Biol. Chem. 247 5629-5631; Wells et al. (1983) Nucleic Acids Res. 11 7911-7925; Stahl and Ferrari (1984) J. Bacteriol. 159 811-819, Jacobs et al. (1985) Nucl. Acids Res. 13 8913-8926; Nedkov et al. (1985) Biol. Chem. Hoppe-Seyler 366 421-430, Svendsen et al. (1986) FEBS Lett. 196 228-232), one subtilisin from an actinomycetales, thermitase from *Thermoactinomyces vulgaris* (Meloun et al. (1985) FEBS Lett. 198 195-200), and one fungal subtilisin, proteinase K from *Tritirachium* album (Jany and Mayer (1985) Biol. Chem. Hoppe-Seyler 366 584-492). for further reference Table I from Siezen et al. has been reproduced below.

Subtilisins are well-characterized physically and chemically. In addition to knowledge of the primary structure (amino acid sequence) of these enzymes, over 50 high resolution X-ray structures of subtilisins have been determined which delineate the binding of substrate, transition state, products, at least three different protease inhibitors, and define the structural consequences for natural variation (Kraut (1977) Ann. Rev. Biochem. 46 331-358).

One subgroup of the subtilases, I-S1, comprises the "classical" subtilisins, such as subtilisin 168, subtilisin BPN', subtilisin Carlsberg (ALCALASE®, Novozymes A/S), and subtilisin DY. A further subgroup of the subtilases I-S2, is recognised by Siezen et al. (supra). Sub-group I-S2 proteases are described as highly alkaline subtilisins and comprise enzymes such as subtilisin PB92 (MAXACAL®, Gist-Brocades NV), subtilisin 309 (SAVINASE®, Novozymes A/S), subtilisin 147 (ESPERASE®, Novozymes NS), and alkaline elastase YaB.

Random and site-directed mutations of the subtilase gene have both arisen from knowledge of the physical and chemical properties of the enzyme and contributed information relating to subtilase's catalytic activity, substrate specificity, tertiary structure, etc. (Wells et al. (1987) Proc. Natl. Acad. Sci. U.S.A. 84; 1219-1223; Wells et al. (1986) Phil. Trans. R. Soc. Lond. A. 317 415-423; Hwang and Warshel (1987) Biochem. 26 2669-2673; Rao et al., (1987) Nature 328 551-554.

More recent publications covering this area are Carter et al. (1989) Proteins 6 240-248 relating to design of variants that cleave a specific target sequence in a substrate (positions 24 and 64); Graycar et al. (1992) Annals of the New York Academy of Sciences 672 71-79 discussing a number of previously published results; and Takagi (1993) Int. J. Biochem. 25 307-312 also reviewing previous results.

Examples of commercially available proteases (peptidases) include Kannase™, Everlase™, Esperase™, Alcalase™, Neutrase™, Durazym™, Savinase™, Ovozyme™, Pyrase™, Pancreatic Trypsin NOVO (PTN), Bio-Feed™ Pro and Clear-Lens™ Pro (all available from Novozymes A/S, Bagsvaerd, Denmark). Other preferred proteases include those described in WO 01/58275 and WO 01/58276.

Other commercially available proteases include Ronozyme™ Pro, Maxatase™, Maxacal™, Maxapem™, Opticlean™, Propease™, Purafect™ and Purafect Ox™ (available from Genencor International Inc., Gist-Brocades, BASF, or DSM Nutritional Products).

Lipases: Suitable lipases include those of bacterial or fungal origin. Chemically or genetically modified mutants are included.

Examples of useful lipases include a *Humicola lanuginosa* lipase, e.g., as described in EP 258 068 and EP 305 216, a *Rhizomucor miehei* lipase, e.g., as described in EP 238 023, a *Candida* lipase, such as a *C. antarctica* lipase, e.g., the *C. antarctica* lipase A or B described in EP 214 761, a *Pseu-domonas* lipase such as a *P. pseudoalcaligenes* and *P. alcali-genes* lipase, e.g., as described in EP 218 272, a *P. cepacia* lipase, e.g., as described in EP 331 376, a *P. stutzeri* li-pase, e.g., as disclosed in BP 1,372,034, a *P. fluorescens* lipase, a *Bacillus* lipase, e.g., a *B. subtilis* lipase (Dar-tois et al., (1993), Biochemica et Biophysica acta 1131, 253-260), a *B. stearothermophilus* lipase (JP 64/744992) and a *B. pumilus* lipase (WO 91/16422).

Furthermore, a number of cloned lipases may be useful, including the *Penicillium camenbertii* lipase described by Ya-maguchi et al., (1991), Gene 103, 61-67), the *Geotricum can-didum* lipase (Schimada, Y. et al., (1989), J. Biochem. 106, 383-388), and various *Rhizopus* lipases such as a *R. delemar* lipase (Hass, M. J et al., (1991), Gene 109, 117-113), a *R. niveus* lipase (Kugimiya et al., (1992), Biosci. Biotech. Bio-chem. 56, 716-719) and a *R. oryzae* lipase.

Other types of lipolytic enzymes such as cutinases may also be useful, e.g., a cutinase derived from *Pseudomonas mendocina* as described in WO 88/09367, or a cutinase derived from *Fusarium solani* pisi (e.g. described in WO 90/09446).

Examples of commercially available lipases include Lipex™, Lipoprime™, Lipopan™, Lipolase™, Lipolase™ Ultra, Lipozyme™, Palatase™, Resinase™, Novozym™ 435 and Lecitase™ (all available from Novozymes A/S).

Other commercially available lipases include Lumafast™ (*Pseudomonas mendocina* lipase from Genencor International Inc.); Lipomax™ (*Ps. pseudoalcaligenes* lipase from Gist-Brocades/Genencor Int. Inc.; and *Bacillus* sp. lipase from Solvay enzymes. Further lipases are available from other suppliers such as Lipase P "Amano" (Amano Pharmaceutical Co. Ltd.).

Amylases: Suitable amylases ($\alpha$ and/or $\beta$) include those of bacterial or fungal origin. Chemically or genetically modified mutants are included. Amylases include, for example, a-amylases obtained from a special strain of *B. licheniformis,* described in more detail in British Patent Specification No. 1,296,839. Commercially available amylases are Duramyl™, Termamyl™, Fungamyl™ and BAN™ (available from Novozymes A/S) and Rapidase™ and Maxamyl P™(available from Gist-Brocades).

Cellulases: Suitable cellulases include those of bacterial or fungal origin. Chemically or genetically modified mutants are included. Suitable cellulases are disclosed in U.S. Pat. No. 4,435,307, which discloses fungal cellulases produced from Humicola insolens. Especially suitable cellulases are the cellulases having color care benefits. Examples of such cellulases are cellulases described in European patent application No. 0 495 257.

Oxidoreductases: Any oxidoreductase suitable for use in a liquid composition, e.g., peroxidases or oxidases such as laccases, can be used herein. Suitable peroxidases herein include those of plant, bacterial or fungal origin. Chemically or genetically modified mutants are included. Examples of suitable peroxidases are those derived from a strain of *Coprinus,* e.g., *C. cinerius* or *C. macrorhizus,* or from a strain of *Bacillus,* e.g., *B. pumilus,* particularly peroxidase according to WO 91/05858. Suitable laccases herein include those of bacterial or fungal origin. Chemically or genetically modified mutants are included. Examples of suitable laccases are those obtainable from a strain of *Trametes,* e.g., *T. villosa* or *T. versicolor,* or from a strain of *Coprinus,* e.g., *C. cinereus,* or from a strain of *Myceliophthora,* e.g., *M. thermophila.*

The types of enzymes which may be present in the liquid of the invention include oxidoreductases (EC 1.-.-.-), transferases (EC 2.-.-.-), hydrolases (EC 3.-.-.-), lyases (EC 4.-.-.-), isomerases (EC 5.-.-.-) and ligases (EC 6.-.-.-).

Preferred oxidoreductases in the context of the invention are peroxidases (EC 1.11.1), laccases (EC 1.10.3.2) and glucose oxidases (EC 1.1.3.4)]. An Example of a commercially available oxidoreductase (EC 1.-.-.-) is Gluzyme (enzyme available from Novozymes A/S).

Further oxidoreductases are available from other suppliers. Preferred transferases are transferases in any of the following sub-classes:

a Transferases transferring one-carbon groups (EC 2.1);

b transferases transferring aldehyde or ketone residues (EC 2.2); acyltransferases (EC 2.3);

c glycosyltransferases (EC 2.4);

d transferases transferring alkyl or aryl groups, other that methyl groups (EC 2.5); and e transferases transferring nitrogeneous groups (EC 2.6).

A most preferred type of transferase in the context of the invention is a transglutaminase (protein-glutamine-glutamyltransferase; EC 2.3.2.13).

Further examples of suitable transglutaminases are described in WO 96/06931 (Novo Nordisk A/S).

Preferred hydrolases in the context of the invention are: carboxylic ester hydrolases (EC 3.1.1.-) such as lipases (EC 3.1.1.3); phytases (EC 3.1.3.-), e.g. 3-phytases (EC 3.1.3.8) and 6-phytases (EC 3.1.3.26); glycosidases (EC 3.2, which fall within a group denoted herein as "carbohydrases"), such as -amylases (EC 3.2.1.1); peptidases (EC 3.4, also known as proteases); and other carbonyl hydrolases. Examples of commercially available phytases include Bio-Feed™ Phytase (Novozymes), Ronozyme™ P (DSM Nutritional Products), Natuphos™ (BASF), Finase™ (AB Enzymes), and the Phyzyme™ product series (Danisco). Other preferred phytases include those described in WO 98/28408, WO 00/43503, and WO 03/066847.

In the present context, the term "carbohydrase" is used to denote not only enzymes capable of breaking down carbohydrate chains (e.g. starches or cellulose) of especially five- and six-membered ring structures (i.e. glycosidases, EC 3.2), but also enzymes capable of isomerizing carbohydrates, e.g. six-membered ring structures such as D-glucose to five-membered ring structures such as D-fructose.

Carbohydrases of relevance include the following (EC numbers in parentheses):

α-amylases (EC 3.2.1.1), β-amylases (EC 3.2.1.2), glucan 1,4-α-glucosidases (EC 3.2.1.3), endo-1,4-beta-glucanase (cellulases, EC 3.2.1.4), endo-1,3(4)-β-glucanases (EC 3.2.1.6), endo-1,4-β-xylanases (EC 3.2.1.8), dextranases (EC 3.2.1.11), chitinases (EC 3.2.1.14), polygalacturonases (EC 3.2.1.15), lysozymes (EC 3.2.1.17), β-glucosidases (EC 3.2.1.21), α-galactosidases (EC 3.2.1.22), β-galactosidases (EC 3.2.1.23), amylo-1,6-glucosidases (EC 3.2.1.33), xylan 1,4-β-xylosidases (EC 3.2.1.37), glucan endo-1,3-β-D-glucosidases (EC 3.2.1.39), α-dextrin endo-1,6-α-glucosidases (EC3.2.1.41), sucrose α-glucosidases (EC 3.2.1.48), glucan endo-1,3-α-glucosidases (EC 3.2.1.59), glucan 1,4-β-glucosidases (EC 3.2.1.74), glucan endo-1,6-β-glucosidases (EC 3.2.1.75), galactanases (EC 3.2.1.89), arabinan endo-1,5-α-L-arabinosidases (EC 3.2.1.99), lactases (EC 3.2.1.108), chitosanases (EC 3.2.1.132) and xylose isomerases (EC 5.3.1.5).

Examples of commercially available carbohydrases include Alpha-Gal™, Bio-Feed™ Alpha, Bio-Feed™ Beta, Bio-Feed™ Plus, Bio-Feed™ Wheat, Bio-Feed™ Z, Novozyme™ 188, Carezyme™, Celluclast™, Cellusoft™, Celluzyme™, Ceremyl™, Citrozym™, Denimax™, Dezyme™, Dextrozyme™, Duramyl™, Energex™, Finizym™, Fungamyl™, Gamanase™, Glucanex™, Lactozym™, Liquezyme™, Maltogenase™, Natalase™, Pentopan™, Pectinex™, Promozyme™, Pulpzyme™, Novamyl™, Termamyl™, AMG™ (Amyloglucosidase Novo), Maltogenase™, Sweetzyme™ and Aquazym™ (all available from Novozymes A/S). Further carbohydrases are available from other suppliers, such as the Roxazyme™ and Ronozyme™ product series (DSM Nutritional Products), the Avizyme™, Porzyme™ and Grindazyme™ product series (Danisco, Finnfeeds), and Natugrain™ (BASF), Purastar™ and Purastar™ OxAm (Genencor).

Other commercially available enzymes include Mannaway™, Pectaway™, Stainzyme™ and Renozyme™.

Liquid Detergents

According to the invention the liquid detergent composition will beside enzyme(s), inhibitor, and inhibitor booster include one or more surfactants. The detergent composition may, e.g., be a laundry detergent composition or a dishwashing detergent composition.

The detergent will usually contain 0-50% of anionic surfactant such as linear alkylbenzene-sulfonate (LAS), alpha-olefinsulfonate (AOS), alkyl sulfate (fatty alcohol sulfate) (AS), alcohol ethoxysulfate (AEOS or AES), secondary alkanesulfonates (SAS), alpha-sulfo fatty acid methyl esters, alkyl- or alkenylsuccinic acid, or soap. It may also contain 0-40% of nonionic surfactant such as alcohol ethoxylate (AEO or AE), alcohol propoxylate, carboxylated alcohol ethoxylates, nonylphenol ethoxylate, alkylpolyglycoside, alkyldimethylamine oxide, ethoxylated fatty acid monoethanolamide, fatty acid monoethanolamide, or polyhydroxy alkyl fatty acid amide (e.g. as described in WO 92/06154).

Normally the detergent contains 1-65% of a detergent builder, but some dishwashing detergents may contain even up to 90% of a detergent builder, or complexing agent such as zeolite, diphosphate, triphosphate, phosphonate, citrate, nitrilotriacetic acid (NTA), ethylene-diaminetetraacetic acid (EDTA), diethylenetriaminepentaacetic acid (DTMPA), alkyl- or alkenylsuccinic acid, soluble silicates or layered silicates (e.g. SKS-6 from Hoechst).

The detergent builders may be subdivided into phosphorus-containing and non-phosphorous-containing types. Examples of phosphorus-containing inorganic alkaline detergent builders include the water-soluble salts, especially alkali metal pyrophosphates, orthophosphates, polyphosphates and phosphonates. Examples of non-phosphorus-containing inorganic builders include water-soluble alkali metal carbonates, borates and silicates as well as layered disilicates and the various types of water-insoluble crystalline or amorphous alumino silicates of which zeolites is the best known representative.

Non-limiting examples of suitable organic builders include alkali metal, ammonium or substituted ammonium salts of succinates, malonates, fatty acid malonates, fatty acid sulphonates, carboxymethoxy succinates, polyacetates, carboxylates, polycarboxylates, am inopolycarboxylates and polyacetyl carboxylates. The detergent may also be unbuilt, i.e. essentially free of detergent builder.

The detergent may comprise or include one or more polymers. Non-limiting examples are carboxymethylcellulose (CMC), poly(vinylpyrrolidone) (PVP), polyethyleneglycol (PEG), poly(vinyl alcohol) (PVA), polycarboxylates such as polyacrylates, polymaleates, maleic/acrylic acid copolymers and lauryl methacrylate/acrylic acid copolymers.

The detergent composition may contain bleaching agents of the chlorine/bromine-type or the oxygen-type. The bleaching agents may be coated or encapsulated. Examples of inorganic chlorine/bromine-type bleaches are lithium, sodium or calcium hypochlorite or hypobromite as well as chlorinated trisodium phosphate. The bleaching system may also comprise a $H_2O_2$ source such as perborate or percarbonate which may be combined with a peracid-forming bleach activator such as tetraacetylethylenediamine (TAED) or nonanoyloxybenzenesulfonate (NOBS).

Examples of organic chlorine/bromine-type bleaches are heterocyclic N-bromo and N-chloro imides such as trichloroisocyanuric, tribromoisocyanuric, dibromoisocyanuric and dichloroisocyanuric acids, and salts thereof with water solubilizing cations such as potassium and sodium. Hydantoin compounds are also suitable. The bleaching system may also comprise peroxyacids of, e.g., the amide, imide, or sulfone type.

In dishwashing detergents the oxygen bleaches are preferred, for example in the form of an inorganic persalt, preferably with a bleach precursor or as a peroxy acid compound. Typical examples of suitable peroxy bleach compounds are alkali metal perborates, both tetrahydrates and monohydrates, alkali metal percarbonates, persilicates and perphosphates. Preferred activator materials are TAED or NOBS.

The enzyme(s) of the detergent composition of the invention may additionally be stabilized using conventional stabilizing agents, e.g., a polyol such as propylene glycol or glycerol, a sugar or sugar alcohol, or lactic acid.

The detergent may also contain other conventional detergent ingredients such as, e.g., fabric conditioners including clays, deflocculant material, foam boosters/foam depressor (in dishwashing detergents foam depressors), suds suppressors, anti-corrosion agents, soil-suspending agents, anti-soil-redeposition agents, dyes, dehydrating agents, bactericides, optical brighteners, or perfume.

The pH (measured in aqueous solution at use concentration) will usually be neutral or alkaline, e.g. in the range of 7-11. In a particular embodiment of the present invention the pH is between 7 and 9.5. In a more particular embodiment of the present invention the pH is between 8 and 9. It has been found that for certain detergents that the invention works particularly good if the pH of the detergent is between 8 and 9.

The following non-limiting examples further illustrate compositions, methods, and treatments in accordance with the present disclosure. It should be noted that the disclosure is not limited to the specific details embodied in the examples.

EXAMPLES

Example 1

Storage Stability Trial

Detergent base:
55 g anion tenside Na-LAS
105 g anion tenside Surfac LC70
25 g nonionic tenside Neodol 25-3
30 g nonionic tenside Neodol 25-7
40 g $NaCO_3$
33 g SXS (Sodium xylenesulfonate 40% WT solution in water)
17 g citrate-monohydrate
10 g STS (Sodium toluene sulfonate)
10 g ethanol
pH adjusted to pH 9 (NaOH)
Water ad 1000 g
pH 9

The detergent base was diluted 1:1.5 water.

The amount of salt added was 3% salt by weight based on the diluted detergent Base.

The protease was added in an amount of 0.173 KNPU-S/g, specific activity of 395 u/g.

4-FPBA was added in amounts of 0.17 mg/g of diluted detergent base+salt.

The storage conditions were four weeks storage at 40° C. was selected.

| Salt tested | Residual activity (4 weeks at 40° C.) | Cat ion | Anion |
|---|---|---|---|
| Magnesium Chloride | 79% | Mg | Cl |
| Magnesium Nitrate | 55% | Mg | $NO_3$ |
| Armonium Chloride | 49% | NH4 | Cl |
| Armonium Sulfate | 43% | NH4 | $SO_4$ |
| Armonium Nitrate | 41% | NH4 | $NO_3$ |
| Magnesium Sulfate | 37% | Mg | $SO_4$ |
| Potassium Chloride | 34% | K | Cl |
| Sodium Chloride | 32% | Na | Cl |
| Sodium Formiate | 29% | Na | $CHO_2$ |
| Calcium Chloride | 22% | Ca | Cl |
| Sodium Sulfate | 22% | Na | $SO_4$ |
| Sodium Nitrate | 20% | Na | $NO_3$ |
| Sodium Acetate | 20% | Na | $C_2H_3O_2$ |
| Aluminium Chloride | 16% | Al | Cl |
| Sodium Carbonate | 15% | Na | $CO_3$ |
| Sodium Phosphate | 13% | Na | $PO_4$ |
| No Salt | 6% | . . . | . . . |
| Sodium Citrate | 1% | Na | $C_6H_5O_7$ |

It can be concluded that most salts have a positive influence on the stability of the detergent base comprising a phenyl boronic acid derivative. The most promising cations seem to be magnesium and ammonium.

Example 2

Storage Stability Trial

Detergent base:
55 g anion tenside Na-LAS
105 g anion tenside Surfac LC70
25 g nonionic tenside Neodol 25-3
30 g nonionic tenside Neodol 25-7
40 g $NaCO_3$
33 g SXS (Sodium xylenesulfonate 40% WT solution in water)
17 g citrate-monohydrate
10 g STS (Sodium toluene sulfonate)
10 g ethanol
pH adjusted to pH 9 (NaOH)
Water ad 1000 g The detergent base was diluted 1:1.5 water.

The amount of salt added was 3% salt by weight based on the detergent.

The protease was added in an amount of 0.173 KNPU-S/g, specific activity of 395 u/g.

4-FPBA was added in amounts of 0.17 mg/g of detergent+salt.

The storage conditions were two weeks storage at 40° C. was selected.

| Salt tested | Residual activity (2 weeks at 40° C.) | Cat ion | Anion |
|---|---|---|---|
| Zink Chloride | 102% | Zn | Cl |
| Zink Sulfate | 88% | Zn | $SO_4$ |
| No Salt | 33% | . . . | . . . |

Both zinc salts show a significant improvement in stability.

It will be understood that various modifications may be made to the embodiments disclosed herein. Therefore, the above description should not be construed as limiting, but merely as exemplifications of embodiments. Those skilled in art will envision other modifications within the scope and spirit of the claims appended hereto.

The invention claimed is:

1. A liquid composition comprising a dissolved protease, a phenyl boronic acid constituent or a derivative thereof, and at least one added dissolved salt constituent, wherein the anion of the salt constituent is selected from the group consisting of chloride, sulphate, and nitrate, wherein the cation of the salt constituent is selected from the group consisting of Zn, Mg, $NH_4$, and combinations thereof, wherein the salt constituent is present in an amount of 0.5 to 10% by weight of the total composition and the phenyl boronic acid or derivative thereof is

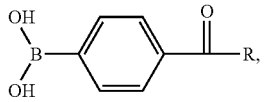

wherein R is selected from the group consisting of hydrogen, hydroxy, $C_1$-$C_6$ alkyl, and $C_1$-$C_6$ alkenyl, and wherein the pH of the liquid composition is 7 to 10.5.

2. The liquid composition of claim 1, wherein the protease is a serine protease.

3. The liquid composition of claim 1, wherein the salt constituent comprises one or more chloride anions.

4. The liquid composition of claim 1, wherein the salt constituent comprises one or more sulphate anions.

5. The liquid composition of claim 1, wherein the pH of the liquid composition is 8 to 9.5.

6. The liquid composition of claim 1, wherein the liquid composition is a detergent composition.

7. The liquid composition of claim 1, wherein the liquid composition is a laundry detergent composition.

8. The liquid composition of claim 1, wherein the liquid composition is a dishwashing composition.

9. The liquid composition of claim 1, wherein the salt constituent comprises magnesium chloride, magnesium sulphate, magnesium nitrate, zinc chloride, zinc sulphate, zinc nitrate, ammonium chloride, ammonium sulphate, ammonium nitrate, or combinations thereof.

10. The liquid composition of claim 1, wherein the one or more cations are selected from the group consisting of Zn or $NH_4$, and combinations thereof.

11. The liquid composition of claim 1, wherein the phenyl boronic acid derivative is 4-formyl-phenyl boronic acid.

12. A process for manufacturing of the liquid composition of claim 1, comprising the steps of:

a) providing a liquid;

b) adding the dissolved salt constituent to the liquid of a);

c) adding the protease and the phenylboronic acid or derivative thereof in a), simultaneously with b) or after b); and d) mixing the liquid composition.

13. The process of claim 12, further comprising the step of adjusting the pH to 7 to 9.5.

14. The process of claim 12, further comprising the step of adjusting the pH to 8 to 9.

* * * * *